US011034053B2

(12) United States Patent
Krentz

(10) Patent No.: US 11,034,053 B2
(45) Date of Patent: Jun. 15, 2021

(54) CONCRETE PRODUCT MACHINE APRON PLATE GAP ADJUSTMENT

(71) Applicant: Besser Company, Alpena, MI (US)

(72) Inventor: Douglas Krentz, Alpena, MI (US)

(73) Assignee: BESSER COMPANY, Alpena, MI (US)

( * ) Notice: Subject to any disclaimer, the term of this patent is extended or adjusted under 35 U.S.C. 154(b) by 0 days.

(21) Appl. No.: 16/891,719

(22) Filed: Jun. 3, 2020

(65) Prior Publication Data

US 2020/0376710 A1 Dec. 3, 2020

Related U.S. Application Data

(60) Provisional application No. 62/856,406, filed on Jun. 3, 2019.

(51) Int. Cl.

| | |
|---|---|
| ***B28B 7/02*** | (2006.01) |
| ***F15B 11/20*** | (2006.01) |
| ***B28B 1/087*** | (2006.01) |

(52) U.S. Cl.

CPC ..... *B28B 7/02* (2013.01); *B28B 1/0873* (2013.01); *F15B 11/20* (2013.01); *F15B 2211/7053* (2013.01); *F15B 2211/71* (2013.01); *F15B 2211/765* (2013.01)

(58) Field of Classification Search

CPC ..... B28B 1/08; B28B 1/084; B28B 1/087; B28B 1/045; B28B 1/873; B28B 2001/0876; E04G 21/061; E04G 21/063; F15B 11/20; F15B 11/205

See application file for complete search history.

(56) References Cited

U.S. PATENT DOCUMENTS

| | | | | |
|---|---|---|---|---|
| 763,261 A | | 6/1904 | Chreitzberg | |
| 2,251,447 A | | 2/1938 | Gelbman et al. | |
| 3,812,900 A | * | 5/1974 | Bollig | B22D 11/208 164/454 |
| 3,856,425 A | * | 12/1974 | Miller | E01C 19/4893 404/84.2 |

(Continued)

FOREIGN PATENT DOCUMENTS

| | | |
|---|---|---|
| CA | 2345769 | 4/2000 |
| CA | 2350979 | 5/2002 |

(Continued)

OTHER PUBLICATIONS

International Search Report dated Jun. 1, 2005 for PCT App. No. PCT/CA2005/000139.

(Continued)

*Primary Examiner* — Thomas E Lazo

(74) *Attorney, Agent, or Firm* — Reising Ethington P.C.

(57) ABSTRACT

Concrete product machine apron gap adjustment by actuating a gapper mechanism to set a desired gap between a reciprocally-movable apron plate and an interchangeably installable mold assembly installed in a concrete products machine. The gapper mechanism sets a desired gap between the machine apron plate and the mold assembly by injecting an index amount of hydraulic fluid into fluid communication with the rod side of a primary apron plate positioning cylinder, causing the machine's apron plate to retreat a desired gap distance away from an engaged position against the mold assembly.

12 Claims, 9 Drawing Sheets

(56) References Cited

U.S. PATENT DOCUMENTS

| | | | | |
|---|---|---|---|---|
| 3,963,397 | A * | 6/1976 | Cruzen | B28B 17/0072 425/141 |
| 4,036,570 | A * | 7/1977 | Cruzen | B28B 17/0072 425/141 |
| 4,095,925 | A * | 6/1978 | Cruzen | B28B 17/0072 425/141 |
| 4,111,627 | A * | 9/1978 | Kitahara | B28B 3/022 425/421 |
| 4,147,491 | A | 4/1979 | Postell, Jr. | |
| 4,568,260 | A | 2/1986 | Paul et al. | |
| 4,848,308 | A * | 7/1989 | Hoppe | B28D 1/265 125/7 |
| 4,978,488 | A | 12/1990 | Wallace | |
| 5,133,915 | A | 7/1992 | Metten et al. | |
| 5,355,732 | A | 10/1994 | Anderi | |
| 6,342,750 | B1 * | 1/2002 | Braungardt | B28B 1/0873 310/323.18 |
| 6,386,268 | B1 * | 5/2002 | Weyer | B22D 11/208 164/454 |
| 6,499,985 | B1 * | 12/2002 | Sekiguchi | B28B 3/028 425/186 |
| 6,561,786 | B2 | 5/2003 | Ciccarello | |
| 6,575,727 | B2 | 6/2003 | Ciccarello et al. | |
| 6,668,816 | B1 | 12/2003 | Pedersen et al. | |
| 6,685,459 | B2 | 2/2004 | Hess et al. | |
| 6,749,793 | B1 | 6/2004 | Hagenah | |
| 6,793,476 | B2 | 9/2004 | Bryja et al. | |
| 6,843,947 | B2 | 1/2005 | Ciccarello et al. | |
| 7,179,077 | B2 * | 2/2007 | Chennells | B28B 1/0873 425/255 |
| 7,635,261 | B2 * | 12/2009 | High | B28B 1/081 425/255 |
| 9,427,887 | B2 * | 8/2016 | Krentz | B06B 1/16 |
| 9,867,323 | B2 * | 1/2018 | Kraggerud | A01B 63/004 |

FOREIGN PATENT DOCUMENTS

| | | |
|---|---|---|
| CA | 2420865 | 2/2003 |
| CA | 2392934 | 1/2004 |
| CA | 2455692 | 7/2004 |
| CA | 2463406 | 10/2004 |
| DE | 4142396 | 6/1995 |

OTHER PUBLICATIONS

Product Information Documents for OMAG, Besser Company; 17 pages.

Rekers Fully Variable Vibration; Rekers Maschinen-u.Antagenbau website; www.rekers.de; 1 page.

Product Information Documents for Servopac; Besser Company; 97 pages.

Product Information Documents for V8; Besser Company; 30 pages.

Besser drawing disclosing a known concrete product machine mold assembly arrangement manufactured and sold by the applicant, Besser.

U.S. Appl. No. 16/407,655, filed May 9, 2019.

* cited by examiner

CONCRETE PRODUCT MACHINE APRON PLATE GAP ADJUSTMENT

CROSS-REFERENCES TO RELATED APPLICATIONS

This application claims the benefit of the filing date of United States Provisional Patent Application Ser. No. 62/856,406, filed Jun. 3, 2019, which is incorporated herein by reference in its entirety.

BACKGROUND

Field

This application relates generally to adjustable feed trays for molding machines.

Description of Related Art Including Information Disclosed Under 37 CFR 1.97 and 1.98 U.S. Pat. No. 7,896,517

Mold assemblies are interchangeably installed in concrete product machines to shape various concrete products. They have varying shapes and sizes, and top plates of these mold assemblies may have differing lateral depths. Apron plates of these concrete products machines need to maintain a certain lateral gap distance from the top plates of the mold assemblies, and this gap distance must be reset every time a different mold assembly is loaded into the concrete products machines, to accommodate dimensional differences in the mold assemblies and/or mold top plates.

Current techniques to achieve and maintain this apron plate gap distance require an operator to move the apron plate away from an installed mold assembly's top plate by pressing a button or throwing switch on a control panel, which actuates hydraulic cylinders attached to the apron plate. The operator measures the resulting apron plate gap with a tape measure as the apron plate is moved, until the gap reaches the desired size. The operator then manually locks the apron plate into position. This manual adjustment and measuring process is time consuming and inefficient—especially when it needs to be performed frequently.

SUMMARY

A concrete product machine apron gap adjustment apparatus is provided, which comprises an apron plate supported on a machine frame for reciprocal movement between a retracted position allowing room for installation of an interchangeable mold assembly, and an engaged position against an installed mold assembly. A primary apron plate positioning cylinder is connected between the apron plate and the machine frame and is configured to move the apron plate between the retracted and engaged positions. A gapper mechanism is in fluid communication with the primary apron plate positioning cylinder and is configured to set a desired gap between the machine apron plate and the mold assembly by injecting an index amount of hydraulic fluid into fluid communication with the primary apron plate positioning cylinder which, in response, causes the machine apron plate to retreat a desired gap distance away from its engaged position against the mold assembly.

In addition, a method is provided for configuring a concrete product machine to automatically set a desired gap between an apron plate of the machine and a mold assembly installed in the machine. The method includes installing an apron plate gapping cylinder in the machine, in fluid communication with a primary apron plate positioning cylinder of the machine, and in electrical communication with a controller of the machine. The method also includes programming a controller to execute the step of commanding the apron plate to advance into engagement with a mold assembly installed in the machine, by actuating the primary apron plate positioning cylinder; as well as the step of commanding the apron plate to retreat from engagement with the mold assembly by the desired gap distance by actuating the gapping cylinder to expel the index amount of hydraulic fluid from the apron plate gapping cylinder into the primary apron plate positioning cylinder.

DRAWING DESCRIPTIONS

DETAILED DESCRIPTION

Figure 1:
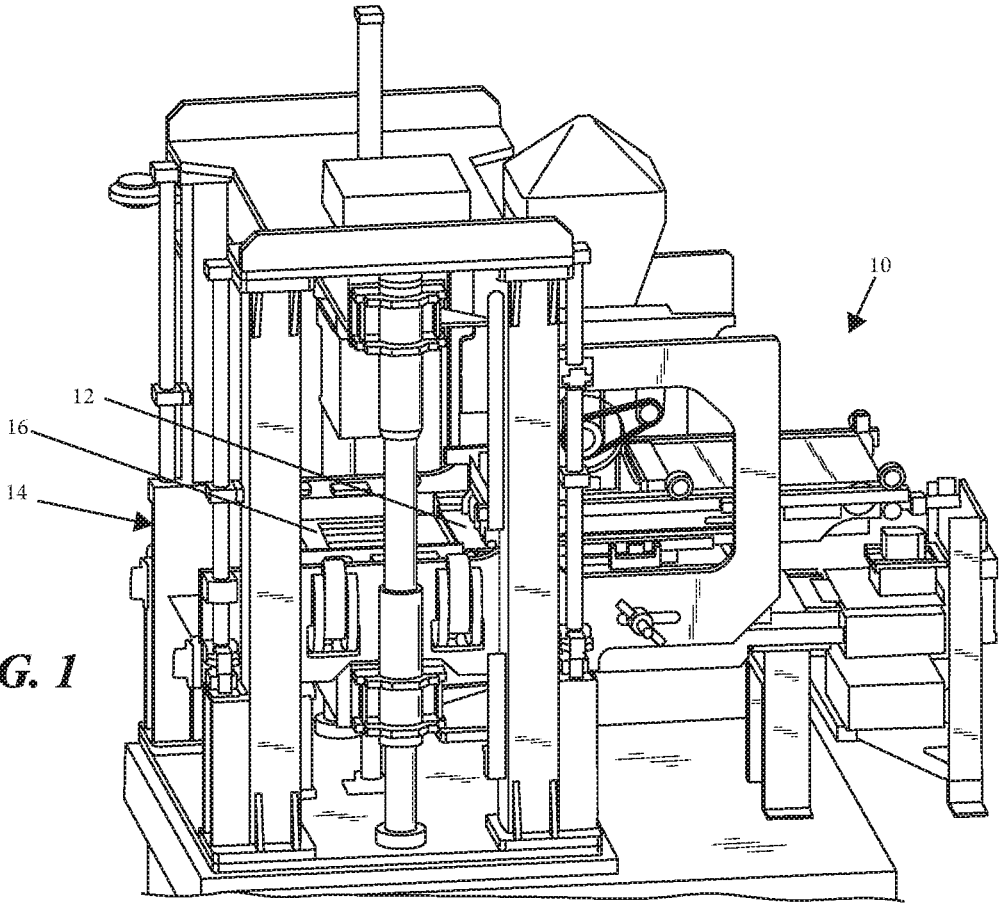
FIG. 1 is an orthogonal view of a concrete product machine comprising an apron plate and an apron gap adjustment apparatus, and having a mold assembly interchangeably installed.
Figure 2:
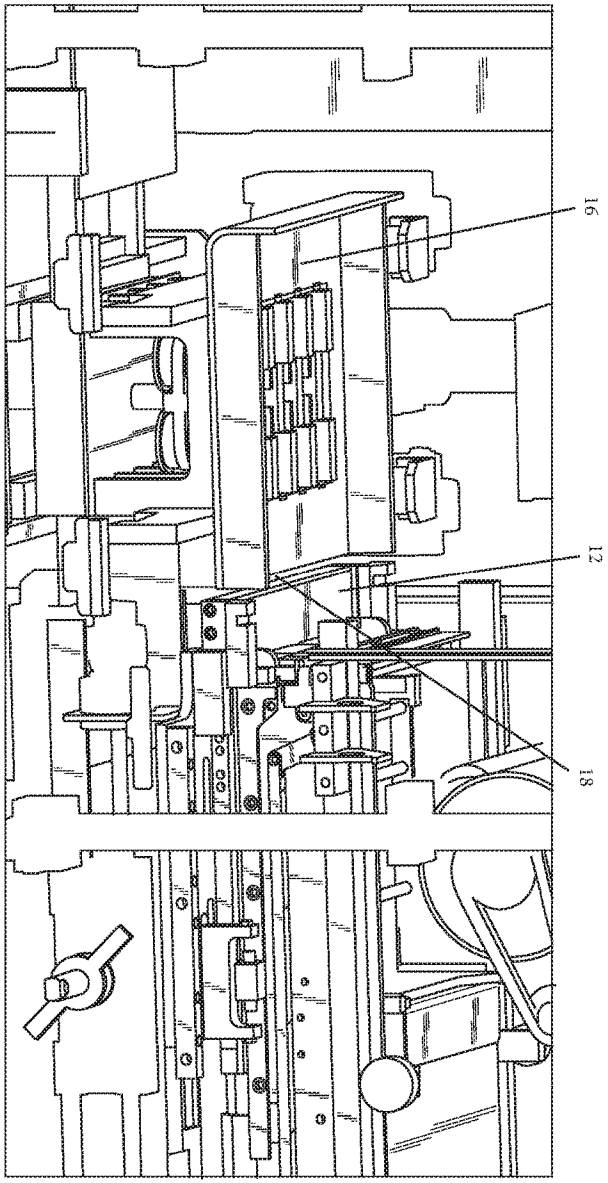
FIG. 2 is a magnified view of a portion of the concrete product machine of FIG. 1 including the apron plate and mold assembly.
Figure 3:
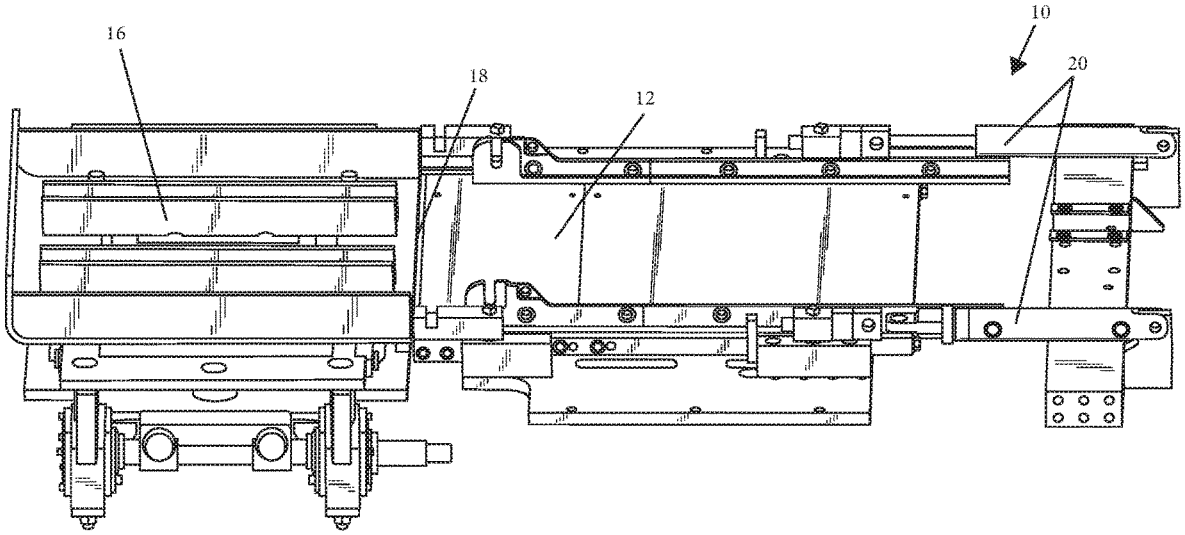
FIG. 3 is an orthogonal view of the apron plate and mold assembly of FIG. 2.

A concrete product machine apron gap adjustment apparatus is shown at 10 in FIGS. 1, 3, and 6-8. The apparatus may include an apron plate 12 supported on a frame of a concrete products machine 14 for reciprocal movement between a retracted position (shown in FIG. 6) that allows room for removal and installation of an interchangeable mold assembly 16, and an engaged position (shown in FIG. 7) against an installed mold assembly 16. Specifically, the apron plate 12 may engage against a top plate 18 of the installed mold assembly 16.

The apparatus 10 may also include at least one, and preferably two, primary apron plate positioning cylinders 20 that may be connected between the apron plate 12 and the machine frame 14. The apparatus 10 may accordingly include at least one, but preferably two, primary apron plate positioning cylinder hydraulic circuits 22, each of which may be connected to and in fluid communication with one of the primary apron plate positioning cylinders 20. The primary apron plate positioning cylinders 20 may be configured and actuable to move the apron plate 12 between the retracted and engaged positions.

Figure 4:
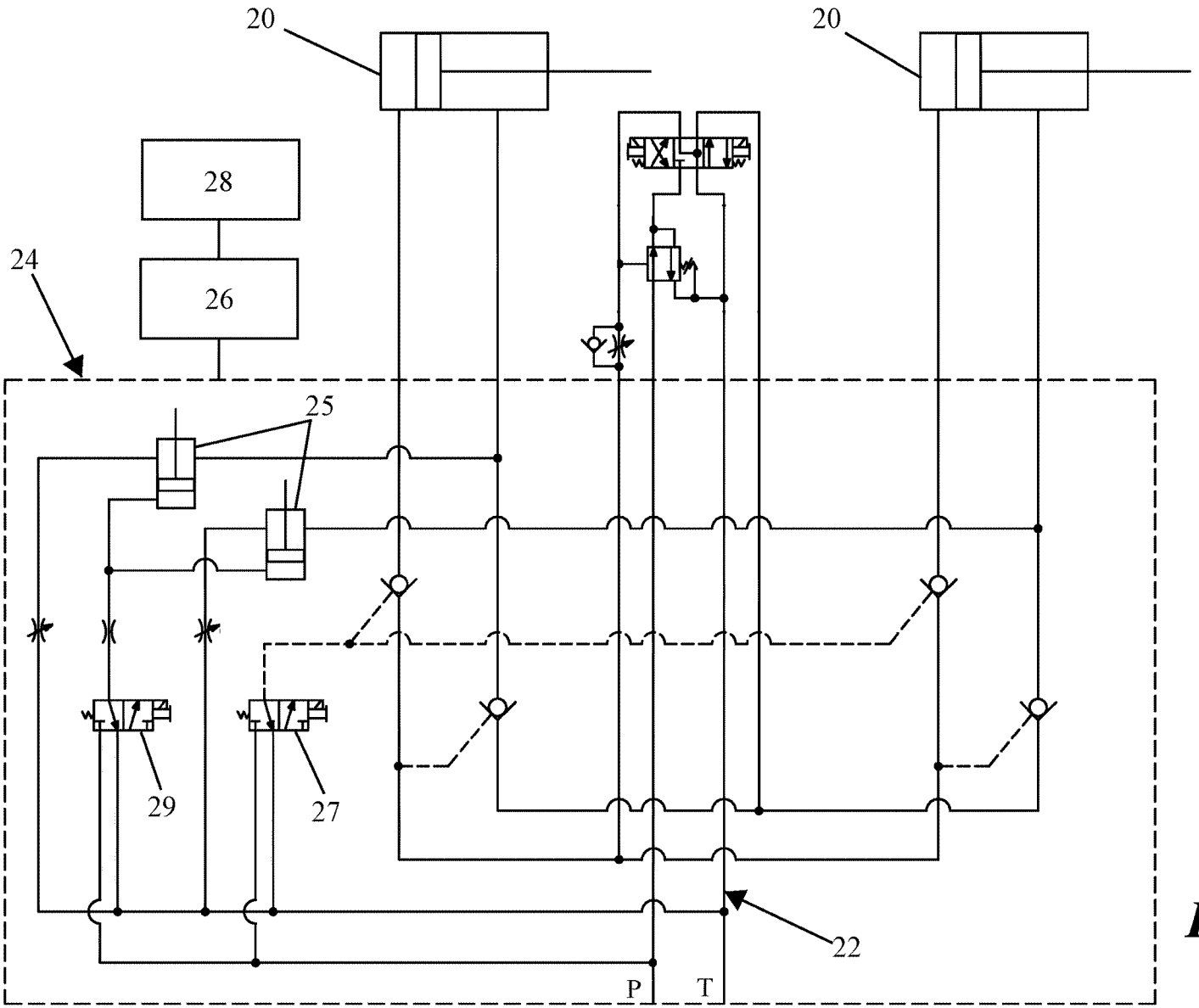
FIG. 4 is a schematic diagram of a hydraulic circuit of the concrete product machine and apron gap adjustment apparatus of FIG. 1.

The apparatus 10 may also include a gapper mechanism 24, as shown in FIG. 4, that may include at least one, but preferably two, apron plate gapping cylinders 25 that may be in fluid communication with the primary apron plate positioning cylinders 20 through the hydraulic circuits 22. The gapper mechanism 24 may also include first and second hydraulic directional valves 27, 29. The first directional valve 27 may be in fluid communication with the gapping cylinders 25, and the first directional valve 27 may be actuable to allow hydraulic fluid to escape from the gapping cylinders 25. The second hydraulic directional valve 29 may be in fluid communication with the two apron plate gapping cylinders 25 via the hydraulic circuit 22. second hydraulic directional valve 29 may be actuable to allow hydraulic fluid to flow into the two apron plate gapping cylinders 25, causing the cylinders to expel fluid into the gapping cylinders 25.

The gapper mechanism 24 may be configured to set a desired gap between the machine apron plate 12 and the mold assembly top plate 18 by injecting an index amount of hydraulic fluid into fluid communication with the primary apron plate positioning cylinders 20, causing the machine apron plate 12 to retreat a desired gap distance away from its engaged position against the mold assembly 16. By injecting an index amount of fluid when the apron plate 12 is in the engaged position, the gapper mechanism 24 ensures that a consistent gap is produced between a mold assembly 16 and the apron plate 12, even if mold assemblies 16 and/or mold assembly top plates 18 of varying dimensions are installed in the apparatus 10. For example, the gapping mechanism 24 may be configured to produce a desired gap of 1/32-1/16 inches, however other gap sizes may be desired according to the needs of the concrete products machine 14.

The apparatus 10 may comprise a controller 26 connected in electrical communication with the gapper mechanism 24 and the apron plate positioning cylinders 20. The controller 26 may be further configured to receive commands from an operator via a human/machine interface (HMI) 28. The controller 26 may be programmed to automatically set a proper gap between the apron plate 12 and the mold assembly 16 in response to a gapping command. According to this programming, when the controller 26 receives the gapping command, the controller 26 should actuate the primary apron plate positioning cylinders 20 to advance the apron plate 12 into engagement with the mold assembly 16, and command the gapping cylinders 25 to expel the index amount of hydraulic fluid from the apron plate gapping cylinders 25 into the primary apron plate positioning cylinders 20, thereby causing the apron plate 12 to retreat the desired gap distance from the mold assembly 16.

Figure 5:
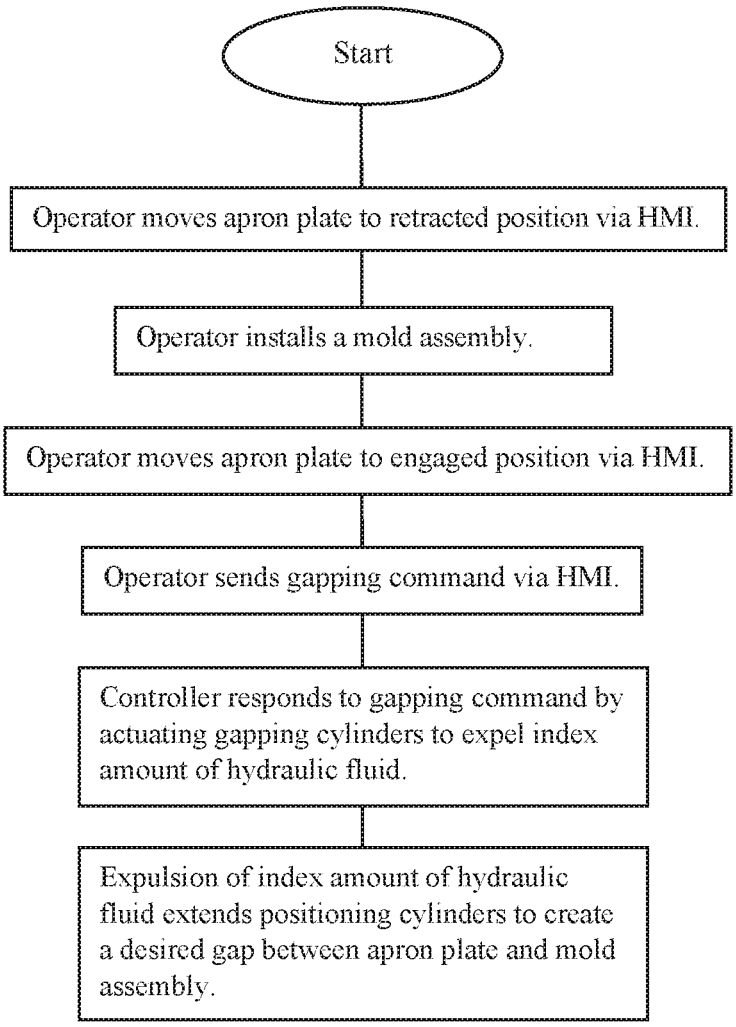
FIG. 5 is a flowchart showing a method for setting a desired apron plate gap between the mold assembly and apron plate of FIG. 3.
Figure 6:
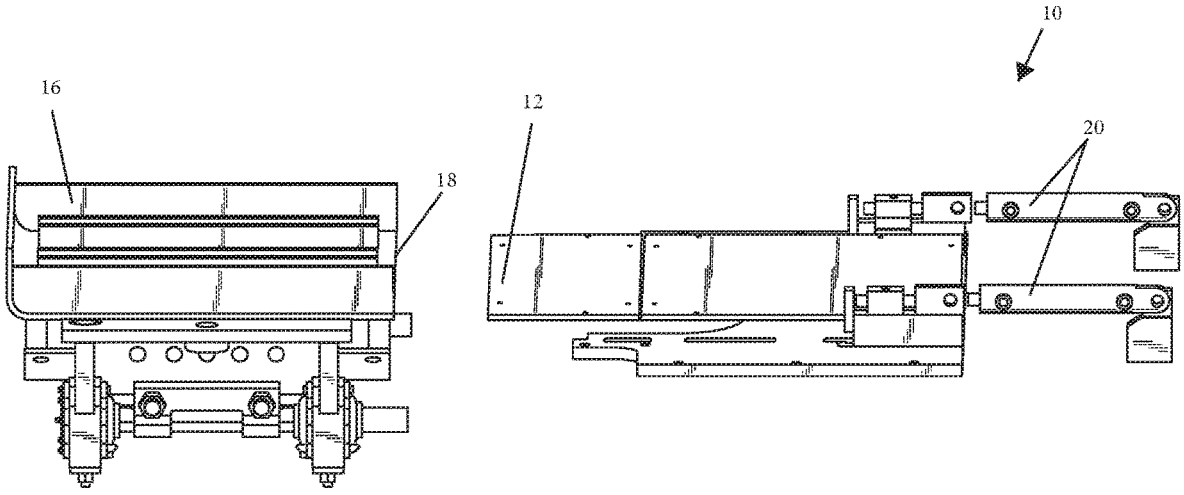
FIG. 6 is an orthogonal view of the apron plate and mold assembly of FIG. 3, with the apron plate in a retracted position providing sufficient space between the apron plate and mold assembly to remove and replace the mold assembly.

In practice, and as shown in FIG. 5, the desired gap may be set between the apron plate 12 and a mold assembly 16 in the concrete product machine 14 via the following procedure:

First, as shown in FIG. 6, the apron plate 12 must be retracted as necessary to provide sufficient space to install an interchangeable mold assembly 16. This may be accomplished by an operator input at the HMI 28, which actuates the apron plate positioning cylinders 20 to retract the apron plate 12. An interchangeable mold assembly 16 may then be installed in the concrete product machine 14.

An operator may issue a gapping command via the HMI 28 to begin the gapping process. The point at which this command is issued may vary, and the gapping command may be included with, or triggered by, other commands. For example, the HMI 28 may be configured and programmed so that the gapping command may be issued by the operator after the mold 16 installation is complete, alternatively, the operator may issue the gapping command as part of an automated series of commands issued by the controller 26 in response to pressing an HMI button that begins the whole mold 16 installation and gapping process. As a further alternative, the gapping command may be automatically issued in response to some other operator input such as the installation of a new mold assembly 16.

Figure 7:
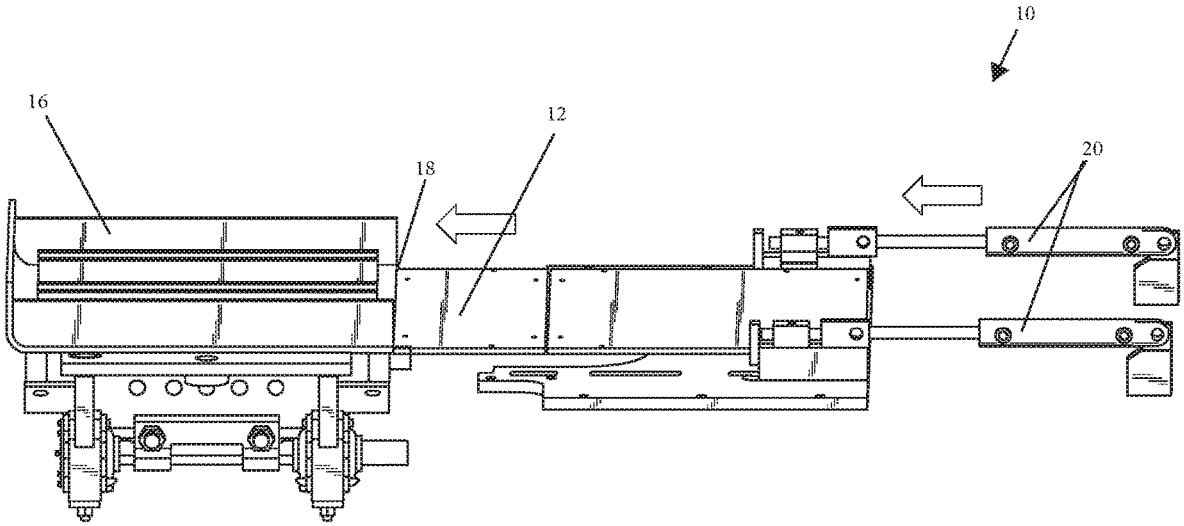
FIG. 7 is an orthogonal view of the apron plate and mold assembly of FIG. 3, with the apron plate in an engaged position against the mold assembly top plate.
Figure 8:
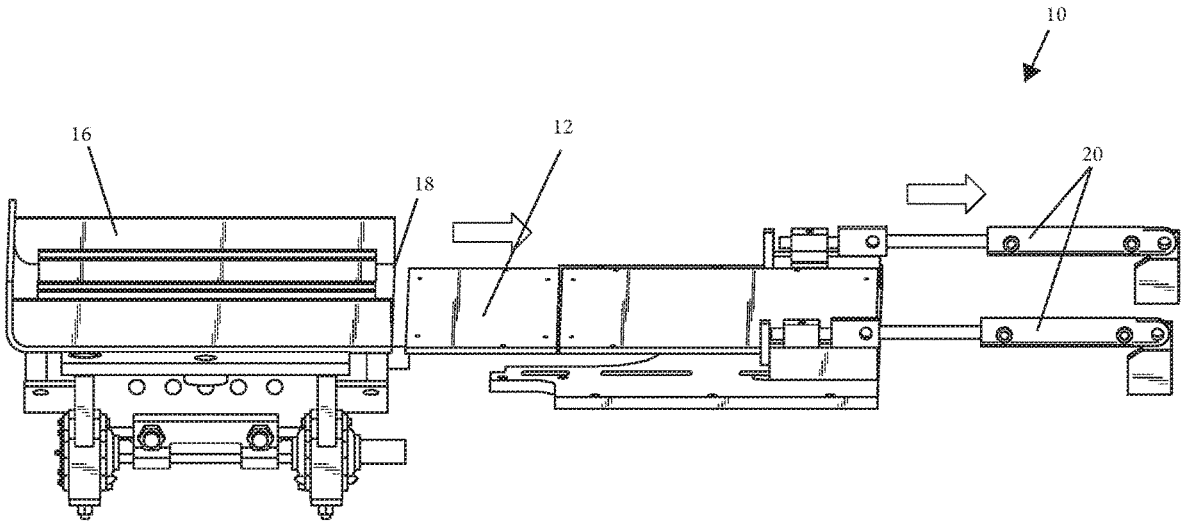
FIG. 8 is an orthogonal view of the apron plate and mold assembly of FIG. 3, with the apron plate spaced the desired gap distance from the mold assembly.

Once the mold assembly 16 is installed, and the gapping command has been issued, the controller 26 may respond to the gapping command by causing the apron plate 12 to advance into engagement with the mold assembly 16 as shown in FIG. 7. The controller 26 may then cause the apron plate 12 to retreat from engagement with the mold assembly 16, as shown in FIG. 8, and create a desired gap between the machine apron plate 12 and the mold assembly 16 by causing an index amount of hydraulic fluid to be expelled from the apron plate gapping cylinders 25 into the rod sides 23 of hydraulic circuits 22 that the primary apron plate positioning cylinders 20 are connected into.

Actuation of the two apron plate gapping cylinders 25 may include causing the first hydraulic directional valve 27 to open and then, ½ second later, causing the second hydraulic directional valve 29 to open, and causing both hydraulic directional valves 27, 29 to remain open for an additional second. This should cause the apron plate gapping cylinders 25 to extend and expel the index amount of hydraulic fluid, which should cause the apron plate 12 to retreat a desired distance of 1/32-1/16 inch away from the mold assembly top plate 18.

Figure 9:
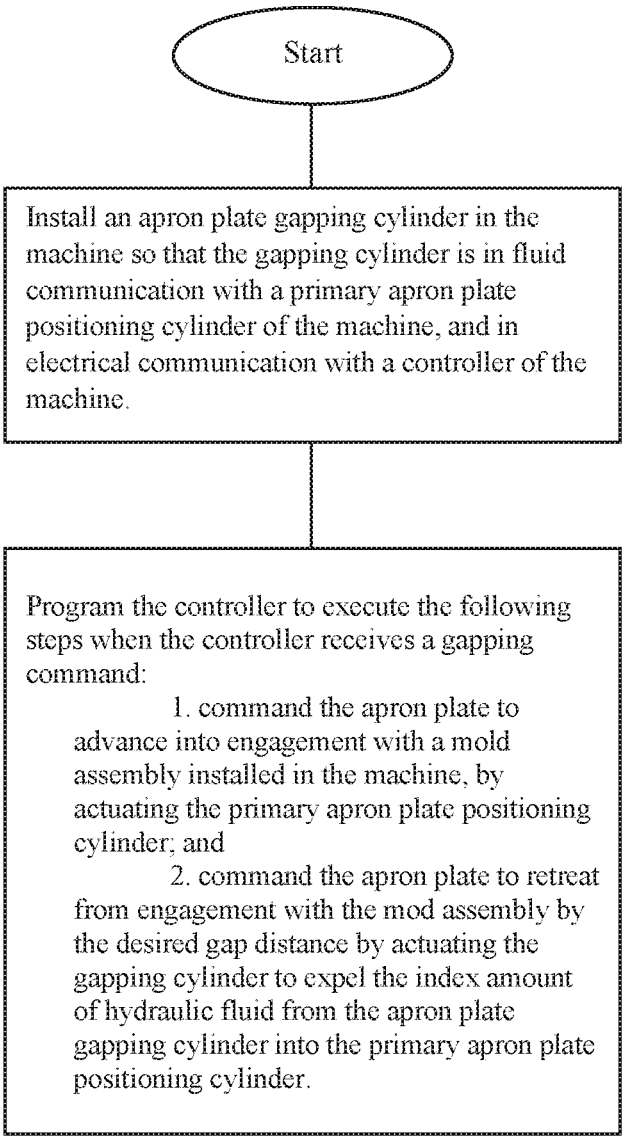
FIG. 9 is a flowchart showing a method of configuring a concrete product machine to automatically set a desired gap between an apron plate of the machine and a mold assembly installed in the machine.

In practice, and as shown in FIG. 9, a concrete products machine 14 may be configured to automatically set a desired gap between an apron plate 12 of the machine and a mold assembly 16 installed in the machine 14 according to the following steps: First, the gapper mechanism 24, including the gapper cylinders 25, may be installed in fluid communication, via the hydraulic circuits 22, with the primary apron plate positioning cylinders 20 of the machine, and in electrical communication with a controller 26 of the machine 14. Next, the controller 26 may be programmed to execute the following steps when the controller 26 receives a gapping command: (1) command the apron plate 12 to advance into engagement with a mold assembly 16 installed in the machine 14, by actuating the primary apron plate positioning cylinders 20; and (2) command the apron plate 12 to retreat from engagement with the mold assembly 16 by the desired gap distance by actuating the gapping cylinders 25 to expel the index amount of hydraulic fluid from the apron plate gapping cylinders 25 into the primary apron plate positioning cylinders 20.

To ensure that the correct gap distance is consistently produced, a target parameter value may be determined that corresponds to the index amount of hydraulic fluid required to be expelled from the apron plate gapping cylinders 25 into a primary apron plate positioning cylinder to produce the desired gap. This target parameter value determination may be performed via various means including trial and error, measurement, experimentation, and/or via calculation. The parameter may, for example, be time; and the target parameter value may be the length of time that a hydraulic valve must remain open to release the index amount of hydraulic fluid. Once the target parameter value is determined, it may be used in the step of programming the controller 26 as a means of controlling the amount of hydraulic fluid expelled by the gapping cylinders 25. For example, the controller 26 may be programmed to expel hydraulic fluid until the controller 26 perceives that the target parameter value has been met.

A concrete product machine apron gap adjustment apparatus constructed as disclosed above, and concrete product machine configuration and apron gap adjustment methods executed as disclosed above, will allow the automatic and consistent setting of a desired gap between a concrete product machine apron plate and any number of differently-configured mold assemblies interchangeably installed in the concrete product machine.

This description, rather than describing limitations of an invention, only illustrates (an) embodiment(s) of the invention recited in the claims. The language of this description is therefore exclusively descriptive and is non-limiting. Obviously, it's possible to modify this invention from what the description teaches. Within the scope of the claims, one may practice the invention other than as disclosed above.

What is claimed is:

1. A concrete product machine apron gap adjustment apparatus comprising:

an apron plate supported on a machine frame for reciprocal movement between a retracted position allowing room for installation of an interchangeable mold assembly, and an engaged position against an installed mold assembly;

a primary apron plate positioning cylinder connected between the apron plate and the machine frame and configured to move the apron plate between the retracted and engaged positions; and a gapper mechanism in fluid communication with the primary apron plate positioning cylinder and configured to set a desired gap between the machine apron plate and the mold assembly by injecting an index amount of hydraulic fluid into fluid communication with the primary apron plate positioning cylinder which, in response, causes the machine apron plate to retreat a desired gap distance away from its engaged position against the mold assembly.

2. A concrete product machine apron gap adjustment apparatus as defined in claim 1 in which:

the apparatus includes a primary apron plate positioning cylinder hydraulic circuit in fluid communication with the primary apron plate positioning cylinder; and the gapper mechanism is connected to the primary apron plate positioning cylinder hydraulic circuit and is configured to inject the index amount of hydraulic fluid into the primary apron plate positioning cylinder hydraulic circuit.

3. A concrete product machine apron gap adjustment apparatus as defined in claim 1 in which the gapper mechanism includes an apron plate gapping cylinder in fluid communication with the primary apron plate positioning cylinder and configured to expel the predetermined amount of hydraulic fluid into fluid communication with the primary apron plate positioning cylinder.

4. A concrete product machine apron gap adjustment apparatus as defined in claim 1 in which the gapper mechanism includes a first hydraulic directional valve in fluid communication with the positioning cylinders and actuable to allow hydraulic fluid to flow out of the positioning cylinders; and a second hydraulic directional valves in fluid communication with the apron plate gapping cylinder and actuable to allow hydraulic fluid to flow into the apron plate gapping cylinder.

5. A concrete product machine apron gap adjustment apparatus as defined in claim 1 in which the gapper mechanism is configured to inject an index amount of hydraulic fluid into fluid communication with the primary apron plate positioning cylinder that will, in response, cause the machine apron plate to retreat a desired gap distance of 1/32-1/16 inch away from its engaged position against the mold assembly.

6. A concrete product machine apron gap adjustment apparatus as defined in claim 1, additionally comprising a controller connected in electrical communication with the gapper mechanism and programmed to command the following steps when the controller receives a gapping command:

advance the apron plate into engagement with a mold assembly installed in the machine, by actuating the primary apron plate positioning cylinder; and cause the apron plate to retreat a desired gap distance from the mold assembly by commanding the gapping cylinder to expel the index amount of hydraulic fluid from the apron plate gapping cylinder into the primary apron plate positioning cylinder.

7. A method for automatic adjustment of apron plate position in the concrete product machine defined in claim 1, the method including:

installing an interchangeable mold assembly in a concrete product machine;

causing the apron plate of the concrete product machine to advance into engagement with the mold assembly;

causing the apron plate to retreat from engagement with the mold assembly and create a desired gap between the machine apron plate and the mold assembly by causing an index amount of hydraulic fluid to be expelled from an apron plate gapping cylinder into the primary apron plate positioning cylinder.

8. The method of claim 7 in which the step of causing the apron plate to retreat includes causing the index amount of hydraulic fluid to be expelled from the apron plate gapping cylinder into a hydraulic circuit that the primary apron plate positioning cylinder is connected into.

9. The method of claim 8 in which the step of causing the index amount of hydraulic fluid to be expelled, includes:

opening a first hydraulic directional valve in fluid communication with the apron plate gapping cylinder;

½ second later, opening a second hydraulic directional valve in fluid communication with the apron plate gapping cylinder; and causing the first and second directional valves to remain open an additional one second.

10. A method for configuring a concrete product machine to automatically set a desired gap between an apron plate of the machine and a mold assembly installed in the machine; the method including:

installing an apron plate gapping cylinder in the machine, in fluid communication with a primary apron plate positioning cylinder of the machine, and in electrical communication with a controller of the machine; and programming the controller to execute the following steps when the controller receives a gapping command:

command the apron plate to advance into engagement with a mold assembly installed in the machine, by actuating the primary apron plate positioning cylinder; and command the apron plate to retreat from engagement with the mold assembly by the desired gap distance by actuating the gapping cylinder to expel the index amount of hydraulic fluid from the apron plate gapping cylinder into the primary apron plate positioning cylinder.

11. The method of claim 10 including the additional steps of:

determining a parameter corresponding to the index amount of hydraulic fluid required to be expelled from the apron plate gapping cylinder into the primary apron plate positioning cylinder to produce the desired gap, and controlling the amount of hydraulic fluid expelled by the gapping cylinder, by programming the controller to, in response to the gapping command, expel hydraulic fluid until the parameter has been met.

12. The method of claim 11 in which the parameter corresponding to an index amount of hydraulic fluid comprises the length of time that a hydraulic valve must remain open in order to release the index amount of hydraulic fluid.

* * * * *